US005226980A

United States Patent [19]

Tsukuta et al.

[11] Patent Number: 5,226,980

[45] Date of Patent: Jul. 13, 1993

[54] SKID RAIL ALLOY

[75] Inventors: Kenji Tsukuta, Chita; Tomohito Iikubo, Nagoya, both of Japan

[73] Assignees: Diado Tokushuko Kabushiki Kaisha, Nagoya, Japan; Inco Alloys International, Inc., Huntington, W. Va.

[21] Appl. No.: 865,742

[22] Filed: Apr. 8, 1992

Related U.S. Application Data

[63] Continuation of Ser. No. 650,105, Feb. 4, 1991, abandoned.

[30] Foreign Application Priority Data

Feb. 6, 1990 [JP] Japan ..... 2-26968

[51] Int. Cl.[5] ..... C22C 30/00

[52] U.S. Cl. ..... 148/419; 148/327; 420/585

[58] Field of Search ..... 148/419, 327, 442; 420/585

[56] References Cited

FOREIGN PATENT DOCUMENTS

| | | | |
|---|---|---|---|
| 53-144411 | 12/1978 | Japan | 420/585 |
| 60-9848 | 1/1985 | Japan | 420/585 |
| 7104328 | 2/1972 | South Africa . | |
| 1309630 | 3/1973 | United Kingdom . | |

*Primary Examiner*—Deborah Yee
*Attorney, Agent, or Firm*—Varndell Legal Group

[57] ABSTRACT

A novel oxide-dispersion strengthened type heat-resistant alloy is provided for use of preparing furnace members such as a skid rail. The alloy consists essentially of up to about 0.2% C+N, up to about 2.0% Si, up to about 2.0% Mn, about 15 to 35% Ni and about 0.2 to 4% Ta, and the balance of Fe, and contains about 0.1–2% of fine particles of high melting point metal oxide such as $Y_2O_3$ dispersed in the austenite matrix.

The alloy exhibits excellent properties of anti-hot deformation, oxidation resistance, abrasion resistance and thermal shock resistance.

4 Claims, 2 Drawing Sheets

SKID RAIL ALLOY

Figure 1:
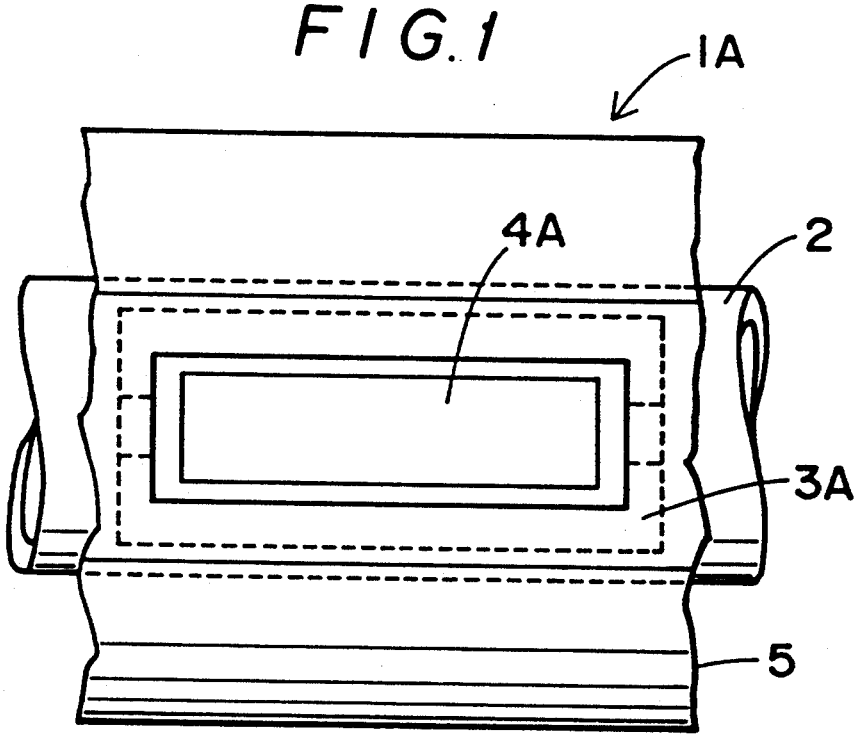

This application is a continuation application of Ser. No. 07/650,105, filed Feb. 4, 1991, now abandoned.

BACKGROUND OF THE INVENTION

1. Technical Field

The present invention concerns a heat-resistant alloy having good strength and anti-corrosion properties at high temperature. The alloy of this invention is suitable as the material for skid rails of furnaces used in, for example, steel industry for heating steel pieces.

2. Prior Art

Steel plates and steel wires are produced by rolling the steel pieces called slabs or billets after uniformly heating them in a heating furnace such as walking beam furnace or pusher furnace. If the temperature of the steel piece is lower at the position where the steel piece contacts the furnace bed than at the remaining positions, then uneven thickness of the rolled steel plate or even cracking may occur. In order to avoid these troubles, it is necessary to raise the temperature of the furnace bed at the position of contact with the heated piece to the temperature near the heating temperature. Thus, at the highest temperatures of use the furnace bed metal attains a temperature as high as 1300° C. or more.

As a typical material for the furnace bed withstanding a high temperature of 1150° C. or higher, there has been used a solid solution strengthened type heat-resistant casting alloy, which contains, in addition to Fe, 20–35% Cr, 15–35% Ni and 5–50% Co as the main components, and 0.5–5% Mo, 0.5–5% W and 0.2–4.0% Ta as the solid solution strengthening elements. However, skid rails in the soaking zone of a furnace are subjected to a high temperature such as 1200°–1350° C., and suffer from heavy strain and abrasion. The above mentioned conventional heat-resistant casting alloy of the solid solution strengthened type is not satisfactory as the material of the skid rails.

It has been proposed to use ceramics having high heat-resistance and anti-abrasion properties as the material of the furnace bed metal (for example, Japanese Utility Model Publication No. 35326/1989). So-called fine ceramics materials such as SiC and $Si_3N_4$ preferable from the viewpoint of high shock-resistance, which is one of the properties required for skid rails, are easily damaged by oxidation when used in a strongly oxidative atmosphere.

On the other hand, super alloys of the oxidedispersion strengthened type, i.e., Ni-based super alloys in which fine particles of an oxide having a high melting point such as $Y_2O_3$ are dispersed, find application in gas-turbines and jet-engines (for example, Japanese Patent Publication No. 38665/1981). As to high temperature furnaces it has been proposed to use an oxide-dispersion strengthened type super alloy of the composition consisting of 12.5–20% Cr, up to 1% Al, up to 0.1% C and up to 0.5% (volume) $Y_2O_3$, the balance being Ni, as the material for mesh belts (Japanese Patent Publication No. 9610/1984).

One of the assignees attempted to use the oxide-dispersion strengthened type super alloys as the material of the skid member of a skid rail, and as the result of research, it was discovered that an oxide-dispersion strengthened type super alloy consisting of 18–40% Cr, up to 5% Ti, the balance being substantially Ni, and containing 0.1–2% of fine particles of a high melting point metal oxide dispersed in the austenite matrix thereof is useful as the material for the skid rail. The discovery has been disclosed (Japanese Patent Application No. 14044/1989).

In the furnaces using heavy oil as the fuel, however, Ni-based super alloys are easily corroded due to high temperature sulfidation attack by the sulfur in the heavy oil. The material having sufficient anti-corrosive properties is, for example, Fe—Ni—Cr—Co—W solid solution strengthened heat resistant cast alloy. If oxide-dispersion strengthened heat resistant alloy having the matrix composition similar thereto is obtained, then the alloy will be a material suitable for the furnace bed metal without the above drawback.

Needless to say, Ni-based alloys are expensive, and therefore, it is desirable to construct the skid rails with a less expensive alloy.

SUMMARY OF THE INVETNION

The general object of the present invention is to provide an alloy having not only high temperature deformation resistance, anti-abrasion property and shock resistance, but also a good oxidation resistance, which are of the same rank as those of the above noted oxide-dispersion strengthened type Ni-based super alloy.

A particular object of the present invention is to provide a heat-resistant alloy of better performance by dispersing oxide particles in the matrix of the heat-resistant alloy of the composition giving the highest ranked high temperature strength and anti high temperature corrosion property as the solid solution strengthened type casting alloy so as to suppress plastic deformation of the matrix at high temperature with the oxide particles.

Another object of the present invention is to provide furnace metals, particularly, skid rails, of higher performance by using the above mentioned heat-resistant alloy.

The alloy according to the present inventiion is an oxide-dispersion strengthened type alloy consisting essentially, based on percent by weight, of up to about 0.2% C+N, up to about 2.0% Si, up to about 2.0% Mn, about 15 to 35% Ni, about 20 to 35% Cr, about 5 to 50% Co, and one or more of 0.5 to 5% Mo, about 0.5 to 5% W and about 0.2 to 4% Ta; and the balance of Fe; and containing about 0.1–2% of fine particles of high melting point metal oxide dispersed in the austenite matrix of the alloy.

The high melting point metal oxide may be one or more selected from $Y_2O_3$, $ZrO_2$ and $Al_2O_3$. $Y_2O_3$ gives the best results.

DRAWINGS

Figure 2:
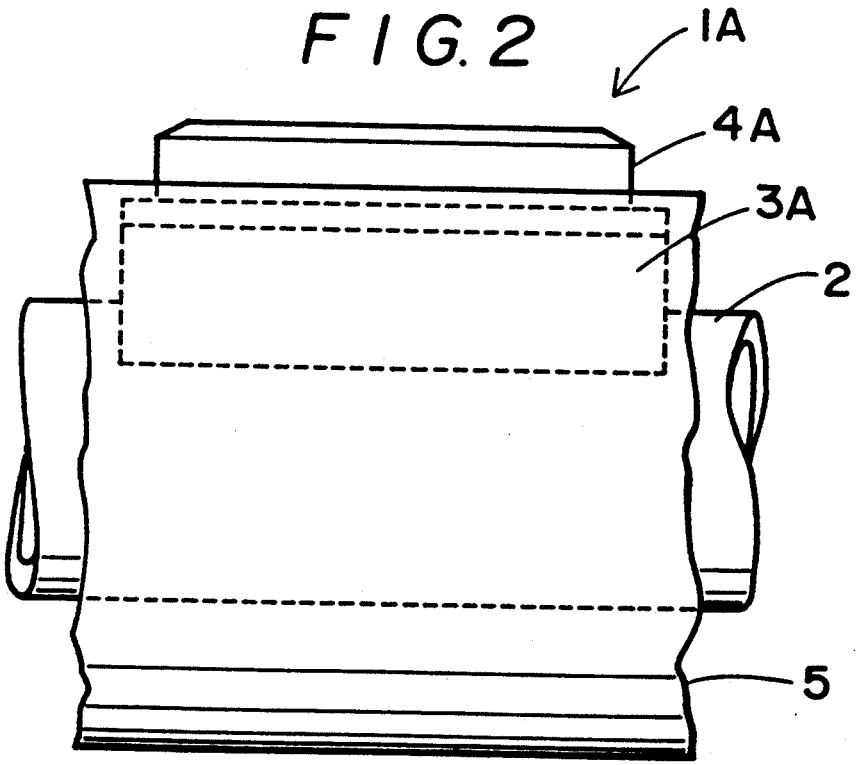
Figure 3:
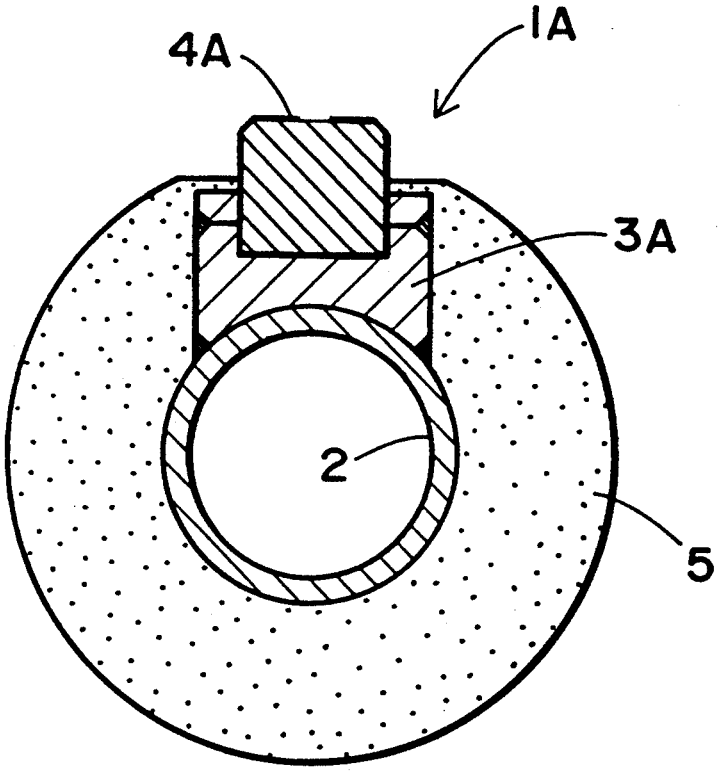

FIG. 1 to FIG. 3 illustrate a typical embodiment of the skid rail using the alloy according to the invention:

FIG. 1 being a plan view;

FIG. 2 a side elevation view; and

FIG. 3 a cross-sectional view.

DETAILED EXPLANATION OF THE PREFERRED EMBODIMENTS

In order to produce the above mentioned oxide-dispersion strengthened type alloy, so-called mechanical alloying technology developed by INCO (The International Nickel Co., Inc.) is useful. The technology comprises subjecting powders of metal components and fine crystals of a high melting point metal oxide in a ball mill, for example, a high kinetic energy type ball mill, so as to produce by repeated welding and fracturing a granular product comprising an intimate and uniform mixture of very fine particles of the components. The product prepared by mechanical alloying is then compacted and sintered by hot extrusion or hot isostatic pressing and, if necessary, machined to the skid member.

A typical embodiment of the skid rail using the alloy of the present invention is, as shown in FIG. 1 to FIG. 3, a skid rail 1A made by welding metal saddles 3A on a water-cooled skid pipe 2, attaching skid members 4A made of the oxide-dispersion strengthened heat-resistant alloy to the saddles and covering all the members except for the skid members 4A with refractory insulator 5. As the material of the skid member, there is used the above oxide-dispersion strengthened type alloy.

The skid rails may be of other configurations. For example, a skid structure may use cylindrical saddles to attach button shaped skid members.

The skid rails may be of the other configuration. For example, a skid structure may use cylindrical saddles to attach button shaped skid members.

In general, nickel-base oxide-dispersion strengthened type super alloys are stable even at a high temperature, and the above mentioned known nickel-base alloys have alloy compositions suitable for the use such as turbine blades (Japanese Patent Publication No. 56-38665) or mesh belts (Japanese Patent Publication No. 59-9610) and contain suitable amounts of oxide particles. However, these known nickel-base alloys do not have sufficient corrosion-resistance against the high temperture sulfidation attack occurring in furnaces having an atmosphere resulting from combustion of heavy oil.

By using the above described oxide-dispersion strengthened alloy according to the present invention, it is possible to achieve a high compression creep strength, as shown in the working example described later, in addition to the heat-resistance and oxidation-resistance. Thus, less expensive, but more durable heat-resistant alloy is provided.

The reasons for selecting the compositions of the present alloy are as follows:

In the heat-resistant alloy of the basic composition,

C+N: Up to about 0.2%

Though C is useful for improving high temperature strength, a content of C+N higher than 0.2% lowers the melting point, and decreases the weldability and the toughness.

Si: Up to about 2.0%

Si improves oxidation resistance of the alloy at high temperature. Too high a content causes precipitation of gamma-phase.

Mn: Up to about 2.0%

Mn is also useful for high temperature oxidation resistance of the alloy, but an excess addition rather deteriorates the property.

Ni: about 15 to 35%

Ni makes the austenite structure stable and enhances the heat-resistance, anti-carburization property and high temperature strength. Less than 15% gives little effect, and at more than 35% the effect saturates.

Cr: about 20 to 35%

It is necessary to add Cr at a content of 20% or more to improve high temperature oxidation resistnace. Excess addition will make the austenite unstable and lower the toughness.

Co: about 5 to 50%

Co is an austenite enstabling element, which dissolves in the matrix to decrease the stacking fault energy, and thus improves the creep strength at a temperature of 1150° C. or higher. For this purpose, addition of at least 5% is necessary. At 50% or more the effect saturates, and it becomes disadvantageous from the economic viewpoint.

One or More of Mo: about 0.5 to 5%, W: about 0.5 to 5.0% and Ta: about 0.2 to 4.0%

These elements dissolve in austenite and strongly increase the high temperature strength and creep strength at a temperature higher than 1000° C.

High Melting Point Metal Oxide: about 0.1–2%

The most preferred metal oxide is, as noted above $Y_2O_3$ In the material for skid rails used in furnaces heated to relatively low temperature (up to about 1200° C.), the whole or a portion of the $Y_2O_3$ may be replaced with $ZrO_2$ or $Al_2O_3$. Of course, combined use of two or three of $Y_2O_3$, $ZrO_2$ and $Al_2O_3$ is possible. Contents of the high melting point metal oxide should be 0.1% or more. Otherwise, the effect of stabilizing the alloy at a high temperature will not be satisfactory. As the content increases, the effect slows down at about 1% and saturates at about 2%, and therefore, a suitable content in this range should be chosen. It should be noted that during processing, originally added $Y_2O_3$ may convert to various yttria-alumina compounds (e.g., YAG) if alumina is copresent.

The alloy according to the present invention will exhibit, when used as the material of the skid rails on other skid surfaces in various furnaces such as heating furnaces for hot processing of steel, excellent properties of anti-hot deformation, oxidation resistance, abrasion resistance and thermal shock resistance, and therefore, it can be used for a long period of time. This will decrease maintenance labor of the heating furnaces and facilitates continuous operation thereof. Decreased costs for energy and maintenance result in lowering production costs in the hot processing of steel.

EXAMPLE

Oxide-dispersion strengthened type alloys of the composition as shown in Table 1 were prepared by the mechanical alloying process, and the alloys were hot extruded and machined to give test samples.

Test samples were subjected to compressive creep test and high temperature oxidation at very high temperature, and the durability and oxidation resistance thereof were compared with those of the conventional material for skid rails, TH101 (0.1C-32Cr-21Ni-23Co-2.5W, Bal. Fe).

The compression creep test is carried out by cramping a columner test piece of 3 mm in diameter and 6.5 mm in hight between a fitting plate and a receiving plate, and applying compressing load at a high temperature. After a certain period of time, the hight of the test piece is measured, and the deformation is calculated as the percentage of decrease in hight.

The deformation (%) at the testing temperatures are as shown in Table 2. The oxidation losses per unit area of the materials after the high temperature oxidation test for various periods are as shown in Table 3.

From reference to the case of alloy No. 4, temperature 1300° C., and testing period 150 hours, it is seen that the oxidation loss of the conventional material reached 356.2 mg/cm$^2$, while the loss of the material according to the present invention was only 17.54 mg/cm². The improvement by the present invention was thus ascertained.

TABLE 1

| No. | C | Si | Mn | Ni | Cr | Co | Mo | W | Ta | N | Oxide | |
|---|---|---|---|---|---|---|---|---|---|---|---|---|
| 1 | 0.12 | 1.2 | 1.2 | 21.0 | 20.0 | 23.9 | 1.5 | 2.5 | 1.5 | 0.015 | $Y_2O_3$ | 0.6 |
| 2 | 0.12 | 1.2 | 1.2 | 21.0 | 15.0 | 23.9 | 1.5 | 2.5 | 1.5 | 0.015 | $Y_2O_3$ | 0.8 |
| 3 | 0.07 | 1.4 | 0.91 | 16.7 | 27.1 | 40.5 | 1.0 | 2.5 | 1.5 | 0.015 | $Y_2O_3$ | 0.7 |
| | | | | | | | | | | | $ZrO_2$ | 0.3 |
| 4 | 0.12 | 1.2 | 1.2 | 21.0 | 32.0 | 23.9 | 1.5 | 2.5 | 1.5 | 0.015 | $Y_2O_3$ | 0.7 |
| | | | | | | | | | | | $Al_2O_3$ | 0.3 |

TABLE 2

| Alloy | Testing Conditions | Period (Hrs) | | | |
|---|---|---|---|---|---|
| | | 20 | 40 | 60 | 80 |
| TH101 | 1200° C. | 3.63 | 6.94 | 9.95 | 13.2 |
| No. 1 | 0.9 kgf/cm² | 0.04 | 0.11 | 0.18 | 0.25 |
| TH101 | 1250° C. | 4.72 | 7.21 | 9.83 | |
| No. 1 | 0.6 kgf/mm² | 0.10 | 0.22 | 0.33 | |
| | | Period (Hrs) | | | |
| | | 10 | 20 | 30 | |
| TH101 | 1300° C. | 2.31 | 4.43 | 6.14 | |
| No. 1 | 0.4 kgf/mm² | 0.08 | 0.18 | 0.27 | |
| No. 2 | | 0.06 | 0.14 | 0.22 | |
| No. 3 | | 0.06 | 0.14 | 0.21 | |
| No. 4 | | 0.08 | 0.17 | 0.25 | |

TABLE 3

| Alloy | Temperature | Oxidation Loss (mg/cm²) | | |
|---|---|---|---|---|
| | | 50 (Hrs) | 100 (Hrs) | 150 (Hrs) |
| TH101 | 1200° C. | 5.53 | 12.3 | 19.1 |
| No. 3 | | 4.32 | 9.10 | 13.8 |

TABLE 3-continued

| Alloy | Temperature | Oxidation Loss (mg/cm²) | | |
|---|---|---|---|---|
| | | 50 (Hrs) | 100 (Hrs) | 150 (Hrs) |
| No. 4 | | 4.10 | 8.52 | 13.2 |
| TH101 | 1250° C. | 6.15 | 57.3 | 250 |
| No. 3 | | 5.31 | 9.42 | 13.82 |
| No. 4 | | 5.12 | 9.38 | 13.26 |
| TH101 | 1300° C. | 40.5 | 175.2 | 356.2 |
| No. 3 | | 12.8 | 15.31 | 18.10 |
| No. 4 | | 12.3 | 14.92 | 17.54 |

We claim:

1. An oxide-dispersion strengthening heat-resistant alloy consisting essentially of up to about 0.2% C+N, up to about 2.0% Si, up to about 2.0% Mn, about 15 to 35% Ni, about 20 to 35% Cr, about 5 to 50% Co; and one or more of about 0.5 to 5% Mo, about 0.5 to 5% W and about 0.2 to 4% Ta; and the balance being Fe, and further containing about 0.1–2 wt % of fine particles of high melting point metal oxide dispersed in the austenite matrix, said alloy having improved strength and oxidation resistance.

2. A heat-resistant alloy according to claim 1 wherein the high melting point metal oxide is $Y_2O_3$.

3. A skid rail using the heat-resistant alloy according to claim 1.

4. A skid rail using the heat-resistant alloy according to claim 2.

* * * * *